US010260311B2

(12) United States Patent
Myhre et al.

(10) Patent No.: US 10,260,311 B2
(45) Date of Patent: Apr. 16, 2019

(54) METHOD FOR COMBINED CLEANING AND PLUGGING IN A WELL AND FLUSHING TOOL FOR FLUSHING IN A WELL

(71) Applicant: Hydra Systems AS, Tananger (NO)

(72) Inventors: Morten Myhre, Tananger (NO); Arne Gunnar Larsen, Sandnes (NO); Patrick Andersen, Hafrsfjord (NO); Roy Inge Jensen, Stavanger (NO); Arnt Olav Dahl, Randaberg (NO)

(73) Assignee: HYDRA SYSTEMS AS, Tananger (NO)

( * ) Notice: Subject to any disclaimer, the term of this patent is extended or adjusted under 35 U.S.C. 154(b) by 572 days.

(21) Appl. No.: 14/381,497

(22) PCT Filed: Mar. 6, 2013

(86) PCT No.: PCT/NO2013/050045

§ 371 (c)(1),
(2) Date: Aug. 27, 2014

(87) PCT Pub. No.: WO2013/133719

PCT Pub. Date: Sep. 12, 2013

(65) Prior Publication Data

US 2015/0021025 A1 Jan. 22, 2015

Related U.S. Application Data

(60) Provisional application No. 61/608,761, filed on Mar. 9, 2012.

(30) Foreign Application Priority Data

Mar. 9, 2012 (NO) ..... 20120277

(51) Int. Cl.
*E21B 33/13* (2006.01)
*E21B 29/00* (2006.01)
(Continued)

(52) U.S. Cl.
CPC ..... *E21B 33/13* (2013.01); *E21B 21/00* (2013.01); *E21B 29/002* (2013.01); *E21B 37/08* (2013.01); *E21B 43/11* (2013.01)

(58) Field of Classification Search
CPC ..... E21B 37/00
(Continued)

(56) References Cited

U.S. PATENT DOCUMENTS 3,064,734 A 11/1962 Toelke
3,811,499 A 5/1974 Hutchison
(Continued)

FOREIGN PATENT DOCUMENTS

CN 203008851 6/2013
GB 2275282 8/1994
(Continued)

OTHER PUBLICATIONS

Arne G. Larsen, HydraWash—A New Approach to Get Cement Behind Casing Without Milling, 2011, Entire Document, HydraWell AS.*

(Continued)

*Primary Examiner* — William D Hutton, Jr.
*Assistant Examiner* — Steven A MacDonald
(74) *Attorney, Agent, or Firm* — Andrus Intellectual Property Law, LLP

(57) ABSTRACT

A method is for the combined perforation, cleaning, and the subsequent plugging of a longitudinal section of a well. The well is provided with two pipe bodies placed substantially concentrically. The method includes lowering a perforation tool into the innermost pipe body to the longitudinal section, forming perforations in both pipe bodies along the longitudinal section with the perforation tool, cleaning the longitudinal section with a flushing tool which is attached to a lower portion of a string allowing through-flow, pumping a
(Continued)

fluidized plugging material down the string and into the innermost pipe body at the longitudinal section, and placing the fluidized plugging material in the innermost pipe body, and thereby also into the entire cross section of the well via the perforations within the longitudinal section. A flushing tool is for cleaning the longitudinal section of the well.

19 Claims, 9 Drawing Sheets

(51) Int. Cl.
*E21B 43/11* (2006.01)
*E21B 21/00* (2006.01)
*E21B 37/08* (2006.01)

(58) Field of Classification Search
USPC ..... 166/297, 298
See application file for complete search history.

(56) References Cited

U.S. PATENT DOCUMENTS

| | | | | |
|---|---|---|---|---|
| 3,850,241 | A | 11/1974 | Hutchinson | |
| 3,958,641 | A * | 5/1976 | Dill | E21B 7/065 166/223 |
| 4,019,576 | A | 4/1977 | Finch | |
| 4,088,191 | A * | 5/1978 | Hutchison | E21B 37/00 166/223 |
| 4,688,640 | A | 8/1987 | Pritchard, Jr. | |
| 4,756,371 | A * | 7/1988 | Brieger | E21B 37/00 166/312 |
| 4,899,821 | A | 2/1990 | Casida | |
| 5,111,885 | A * | 5/1992 | Umphries | E21B 43/116 166/297 |
| 5,178,219 | A | 1/1993 | Striech | |
| 5,377,757 | A | 1/1995 | Ng | |
| 5,472,052 | A * | 12/1995 | Head | E21B 33/13 166/298 |
| 5,474,130 | A | 12/1995 | Davis | |
| 5,564,500 | A | 10/1996 | Rogers et al. | |
| 5,634,984 | A | 4/1997 | Finch | |
| 6,302,201 | B1 | 10/2001 | Elliott | |
| 6,850,241 | B2 | 2/2005 | Champion | |
| 8,584,756 | B1 * | 11/2013 | Barlow | E21B 33/14 166/250.12 |
| 9,010,425 | B2 | 4/2015 | Larsen | |
| 2005/0067162 | A1 * | 3/2005 | Gjedrem | E21B 33/14 166/277 |
| 2006/0048940 | A1 * | 3/2006 | Hromas | E21B 17/06 166/297 |
| 2006/0219441 | A1 * | 10/2006 | Telfer | E21B 17/1078 175/325.7 |
| 2013/0192830 | A1 | 8/2013 | Watson | |
| 2015/0021025 | A1 | 1/2015 | Myhre | |
| 2015/0027705 | A1 | 1/2015 | Larsen | |
| 2015/0053405 | A1 | 2/2015 | Bakken | |

FOREIGN PATENT DOCUMENTS

| | | |
|---|---|---|
| NO | 20111641 | 7/2012 |
| NO | 20120099 | 9/2012 |
| NO | 20120277 | 9/2013 |
| WO | 0125594 | 4/2001 |
| WO | 02081861 | 10/2002 |
| WO | 2012096580 | 7/2012 |
| WO | 2012105852 | 8/2012 |
| WO | 2012128644 | 9/2012 |
| WO | 2013122480 | 8/2013 |
| WO | 2013133719 | 9/2013 |

OTHER PUBLICATIONS

International Search Report and Written Opinion for PCT/NO2013/050045 dated Jun. 26, 2013.

* cited by examiner

METHOD FOR COMBINED CLEANING AND PLUGGING IN A WELL AND FLUSHING TOOL FOR FLUSHING IN A WELL

CROSS-REFERENCE TO RELATED APPLICATIONS

This application is the U.S. national stage application of International Application PCT/NO2013/050045, filed Mar. 6, 2013, which international application was published on Sep. 12, 2013, as International Publication WO2013/133719 in the English language. The international application is incorporated herein by reference, in entirety. The international application claims priority to Norwegian Patent Application No. 20120277 and U.S. Provisional Patent Application 61/608,761, which are incorporated herein by reference.

FIELD

The invention relates to a method for combined cleaning and plugging in a well. More specifically, the invention relates to a method which provides hydraulic isolation in the form of a well plug which is installed in the cross section of the well at a desired depth, wherein the well, at least in the portion where a well plug is to be positioned, is provided with at least two pipe bodies placed substantially concentrically. The invention also relates to a flushing apparatus for use in the method.

BACKGROUND

It is known to establish a harrier in a well by a section of casing being removed mechanically by section milling, after which the cross section of the well is filled with cement. Such an operation is very time-consuming and thus involves large costs for an operator. The operation generally requires surface installations for separating metal chips from the drilling mud and, often, several different types of cleaning fluids are required for metal chips to be transported up from the depth of the well.

It is also known that a well plug may be established by means of a method and devices as proposed in the Norwegian patent application 20111641 entitled "Method for combined cleaning and plugging in a well, washing tool for directional washing in a well, and use of the washing tool" and in the Norwegian patent application 20120099 entitled "Apparatus and method for positioning of a fluidized plugging material in an oil well or gas well", both filed by the present applicant.

In a well in which the portion to be plugged is provided with two or more pipe bodies placed substantially concentrically, it has turned out that the applicant's apparatus for cleaning before plugging, as described in the Norwegian patent document 20111641 mentioned, for a well provided with one pipe body, is not suitable for cleaning in a satisfactory manner. When two pipe bodies are cast together into the well, it has turned out to be difficult to remove residues of the casting material, which may be cement for example, in a satisfactory manner. This casting material may be superannuated and in such condition that it no longer meets the requirements of a barrier element in the well. Further, it has proved difficult to clean in a satisfactory way even when there is no casting material between the pipe bodies, as, when washing as described in said patent application, there will be a pressure drop in the annuli between the pipe bodies.

SUMMARY

The invention has for its object to remedy or reduce at least one of the drawbacks of the prior art or at least provide a useful alternative to the prior art.

The object is achieved through features which are specified in the description below and in the claims that follow.

In a first aspect, the invention relates to a method for the combined perforation, cleaning of annuli in a well over a longitudinal section of the well and subsequent plugging of the longitudinal section, the well being provided, at least over the longitudinal section to be plugged, with at least two pipe bodies placed substantially concentrically, and the method including the following steps:

(A) lowering a perforation tool into the innermost pipe body to said longitudinal second of the well;

(B) forming perforations in the pipe bodies along the longitudinal section by means of the perforation tool, characterized by the method also including the steps of:

(C) by means of a flushing tool which is attached to a lower portion of a string allowing through-flow and which is lowered into the innermost pipe body to the longitudinal section, pumping a flushing fluid down the string, out through at least one outlet of the flushing tool, into the innermost pipe body and further out into the annulus/annuli between the pipe bodies and into the annulus outside the outermost pipe body via the perforations;

(D) pumping a fluidized plugging material down the string and into the innermost pipe body at the longitudinal section; and (E) placing the fluidized plugging material in the innermost pipe body, and thereby also in the annuli via the perforations in the pipe bodies, along at least said longitudinal section of the well, whereby both the pipe bodies and the annuli are plugged along at least said longitudinal section of the well.

The string allowing through-flow may be, for example, a drill string or a coiled-tubing string of types known per se.

In one embodiment, the fluidized plugging material may include cement slurry for the formation of a cement plug.

As an alternative, or in addition, the fluidized plugging material may include a fluidized unconsolidated mass for the formation of an unconsolidated-mass plug.

In a first embodiment, before step (C), the method may include

- lowering the perforation tool into the innermost pipe body and forming said perforations in the pipe bodies along said longitudinal section;
- pulling the perforation tool out of the well; and
- attaching the flushing tool to the lower portion of the string to subsequently perform steps (C)-(E). Perforation and flushing is thus carried out in separate trips down the well.

In a second embodiment, before step (A), the method may further include the following steps:

- connecting the perforation tool and the flushing tool into an assembly of the two;
- connecting the assembly to said lower portion of the string. Perforation and flushing are thus performed in one and the same trip down the well.

In a preferred embodiment, step (C) may include rotating the string while the flushing is going on. This will have the effect of enabling better cleaning of the pipe body and the annuli as, over time, the flushing tool may work a larger area.

In another preferred embodiment, the method may additionally or alternatively include moving the string in a reciprocating motion while flushing is going on. This will have the same effect as that mentioned above for a rotating motion, in addition to making it easier to get at the annuli that are to be cleaned.

In one embodiment, before step (C), the method may include adding an abrasive medium to the flushing fluid. This will be particularly appropriate if the annulus between the two pipe bodies is filled with cement or some other casting material, as this may be difficult to remove without any abrasive media in the flushing fluid.

The abrasive medium may be sand, for example. In a preferred embodiment, the amount of sand added to the flushing fluid may be between 0.05 percent by weight and 1.00 percent by weight. In a particularly preferred embodiment, approximately 0.1 percent by weight of sand may be added to the flushing fluid.

The flushing fluid may be drilling mud of a kind known per se.

In a preferred embodiment, the flushing fluid may be carried out of the at least one outlet of the flushing tool at a rate greater than 15 meters per second. The present applicant has done tests that have shown that 15 meters per second is a limit value above which the flushing tool is able to clean sufficiently.

In a further preferred embodiment, the flushing fluid may be carried out of the at least one outlet of the flushing tool at a rate which is greater than 50 meters per second. The above-mentioned tests have also shown that the flushing is particularly effective when the flushing fluid has an exit velocity greater than 50 meters per second.

Optimum flushing velocities and the amount of abrasive medium added depend on the type of flushing fluid and then primarily on the viscosity of the flushing fluid. High-viscosity flushing fluids will usually require greater exit velocities from the flushing tool as the velocity is retarded faster than that of low-viscosity liquids.

In another preferred embodiment, the flushing fluid may be carried out of the at least one outlet of the flushing tool in a spin-free output jet. The advantage of this is that there is no need for nozzles that are to provide a spinning effect on the output jet, as, these nozzles will usually require larger space for support.

In one embodiment, after step (C), the method may also include using a washing tool as disclosed in said Norwegian patent document 20111641. This may clean the longitudinal section further. Said washing tool could also be used as a base for subsequent plugging by means of a curable fluidized plugging material as described in said patent document.

In another embodiment, after step (C), the method may also include setting a packer element of a kind known per se in the well as a base for subsequent plugging with the fluidized plugging material.

In a second aspect, the invention relates to a flushing tool for flushing in a well, the flushing tool being arranged for connection to a lower portion of a string allowing through-flow, and the flushing tool being formed with at least one outlet allowing through-flow, characterized by at least one of said at least one outlet being angled in such a way that the output jet is non-normal to the longitudinal axis of the flushing tool.

In one embodiment, the output jet from the at least one outlet may be substantially spin-free.

In a first embodiment, a lower end portion of the flushing tool may be arranged to be connected to a perforation tool for perforating surrounding pipe bodies. This may be an advantage as the operations of perforation and flushing may be carried out in one and the same trip down the well.

In a second embodiment, a lower end portion of the flushing tool may be arranged to be releasably connected to said perforation tool. This may be advantageous as the perforation tool may be dumped in the well.

In a preferred embodiment, at least one of said at least one outlet may be provided with a nozzle. This may be practical for the output jet to get the desired concentration and direction.

In a further preferred embodiment, the flushing tool may be formed with a plurality of outlets, the outlets being angled in such a way that the output jets are distributed within ±80° from a plane which is normal to the longitudinal axis of the flushing tool. This will be particularly appropriate with a view to cleaning the annuli as it will be easier to achieve the desired effect with angled output jets. If, in addition, the flushing tool is rotated and/or moved up and down the well during flushing, this may give a very thorough cleaning of the inside and outside of both pipe bodies.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
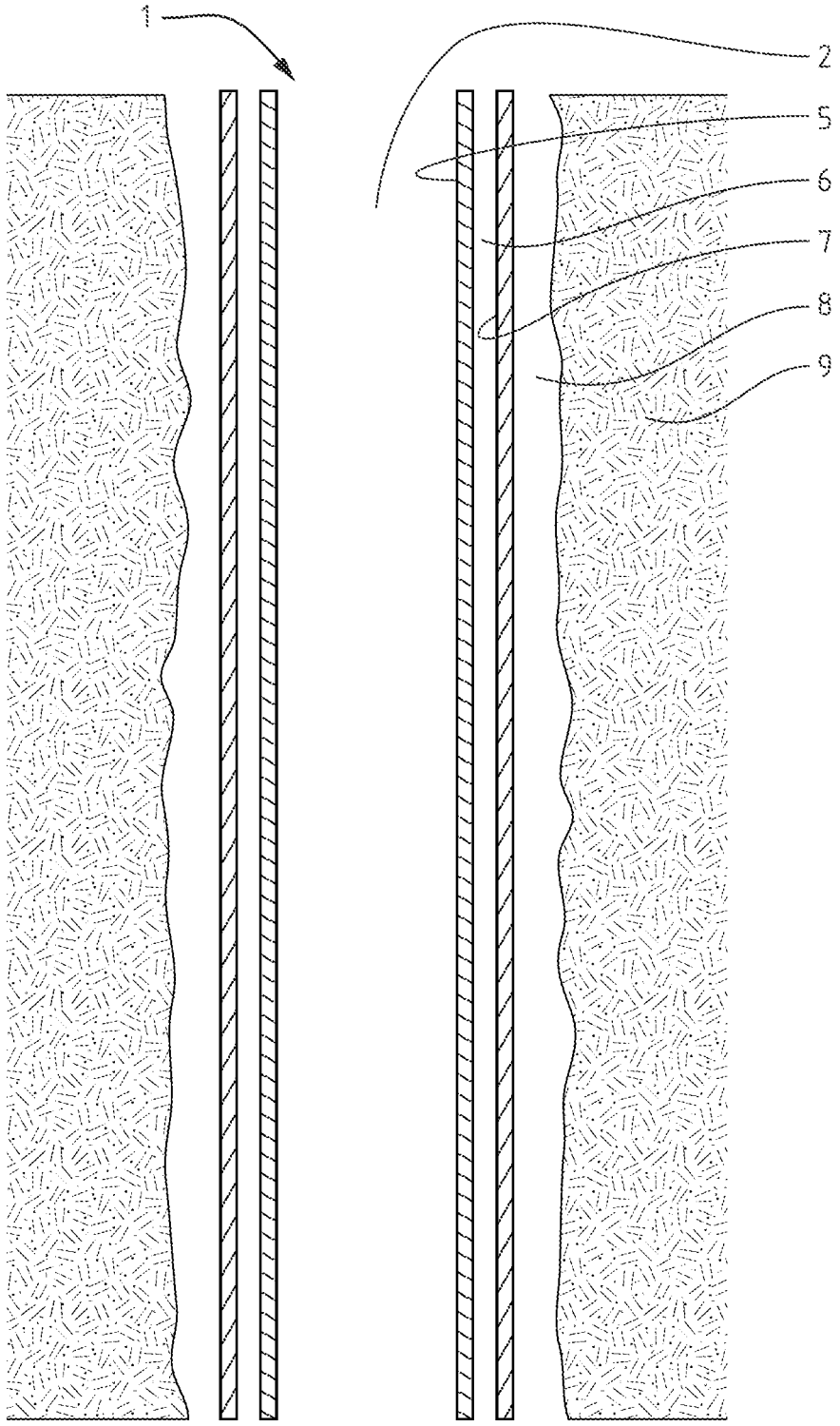
FIG. 1 shows, in a side view, well as used in the present invention.

In what follows, the reference numeral 1 indicates a well as used in the present invention. The well 1 has been drawn in a schematic and very simplified manner, and elements that are not central to the invention may have been omitted from the figures.

FIG. 1 shows the well to be plugged. The well 1 is provided with two pipe bodies 5, 7 placed substantially concentrically, here in the form of two casings. The casings 5, separate a well path 2 from a surrounding formation 9. Well fluids which will be known to a person skilled in the art and which will typically be present in the well 1, inter alia in an annulus 6 between the two casings 5, 7 and in an annulus 8 between the outer casing 7 and the surrounding formation 9, are not shown in the figures for the sake of exposition.

Figure 2:
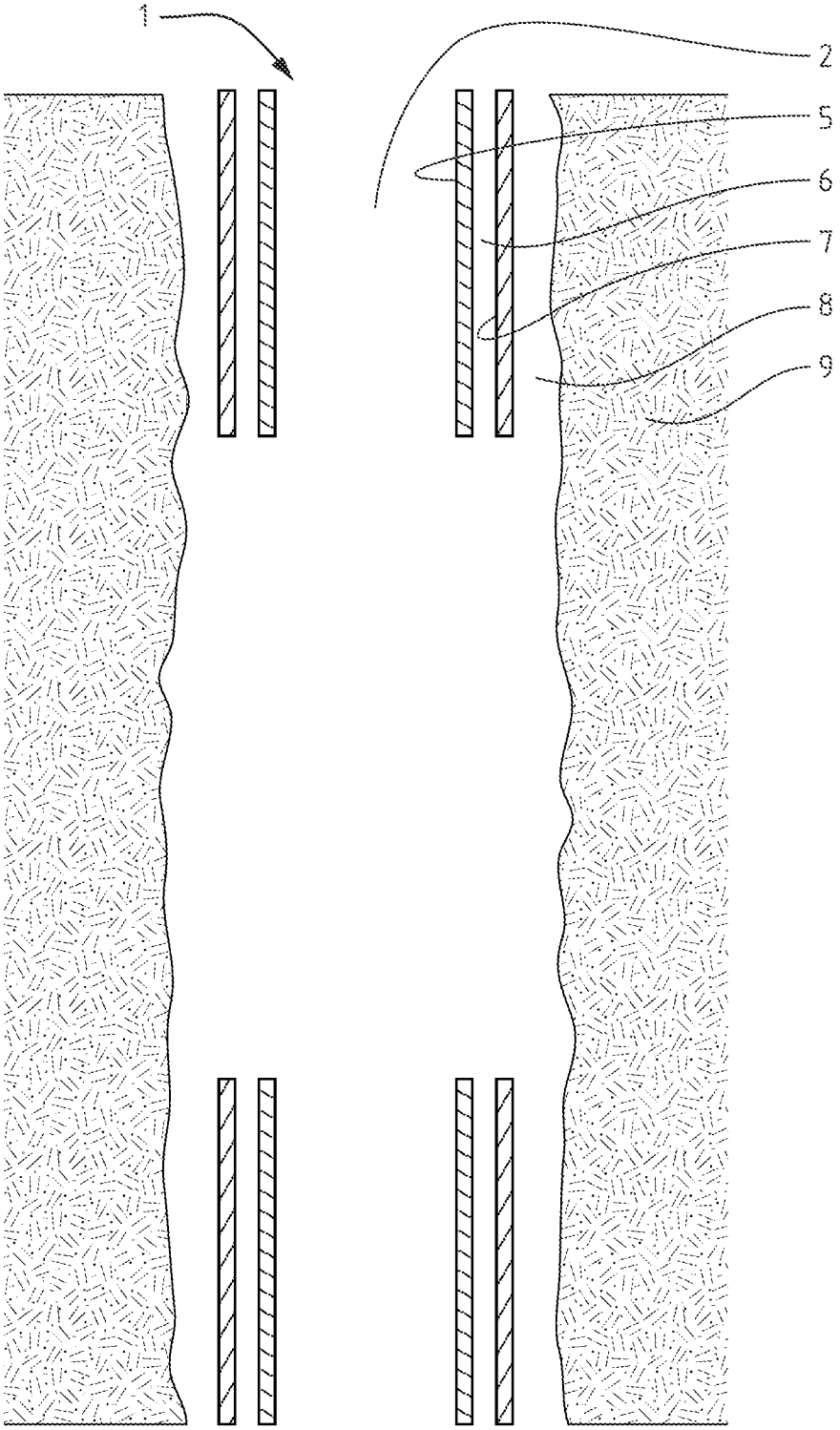
FIG. 2 shows, in a side view, the well after a longer portion of two pipe bodies has been removed, as used in plugging according to the prior art.
Figure 3:
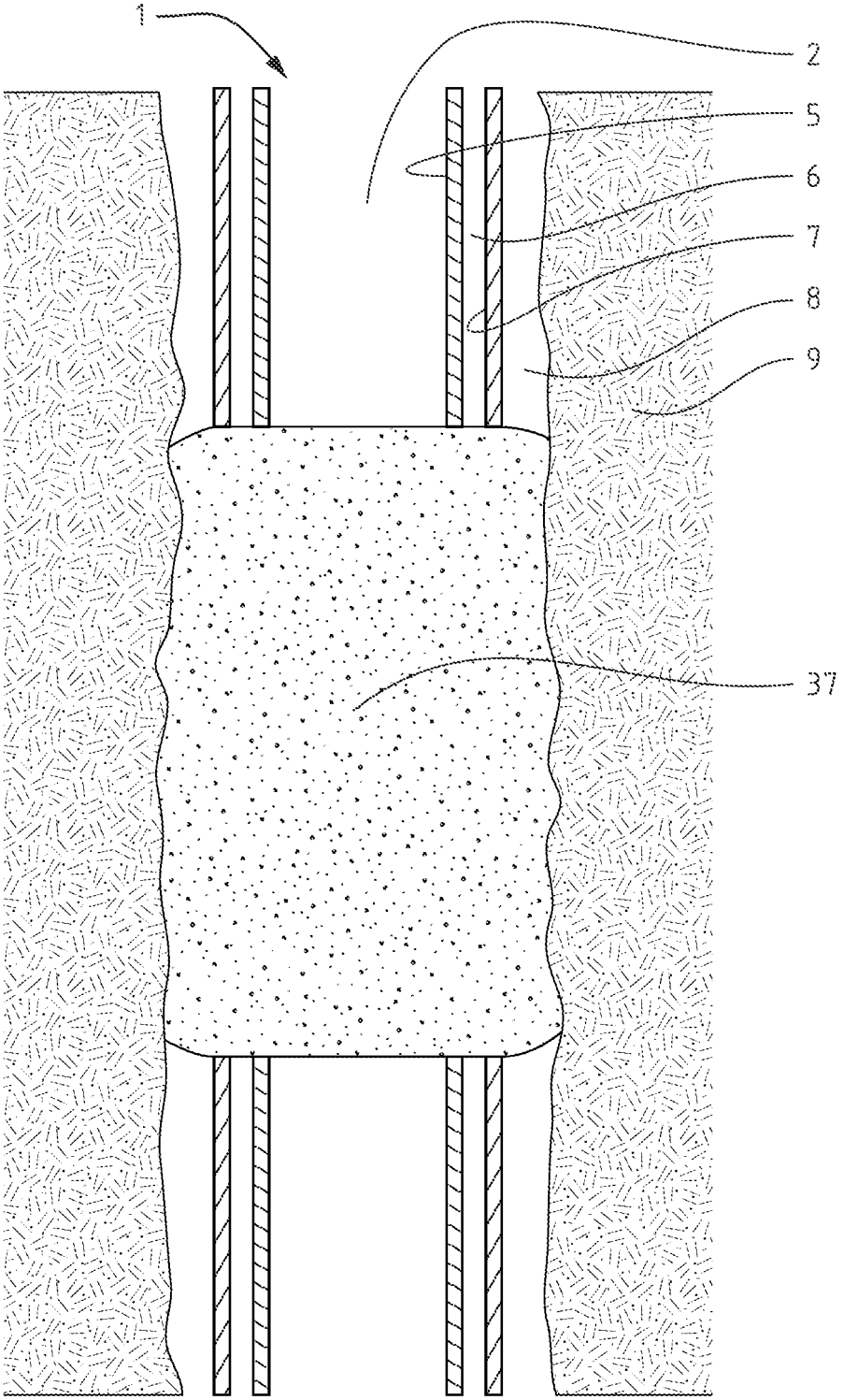
FIG. 3 shows, in a side view, the well of FIG. 2 after a plug has been established in the well by means of the prior art.

FIG. 2 shows how a portion of the casings 5, 7 has been removed for plugging of the well 1 in accordance with the prior art. A major length of the casings 5, 7 is milled away before the cross section of the well 1 is filled by a cement slurry or some other fluidized plugging material 37 for the formation of a plug as shown in FIG. 3. This method has several drawbacks which have been mentioned initially in the present application.

Figure 4:
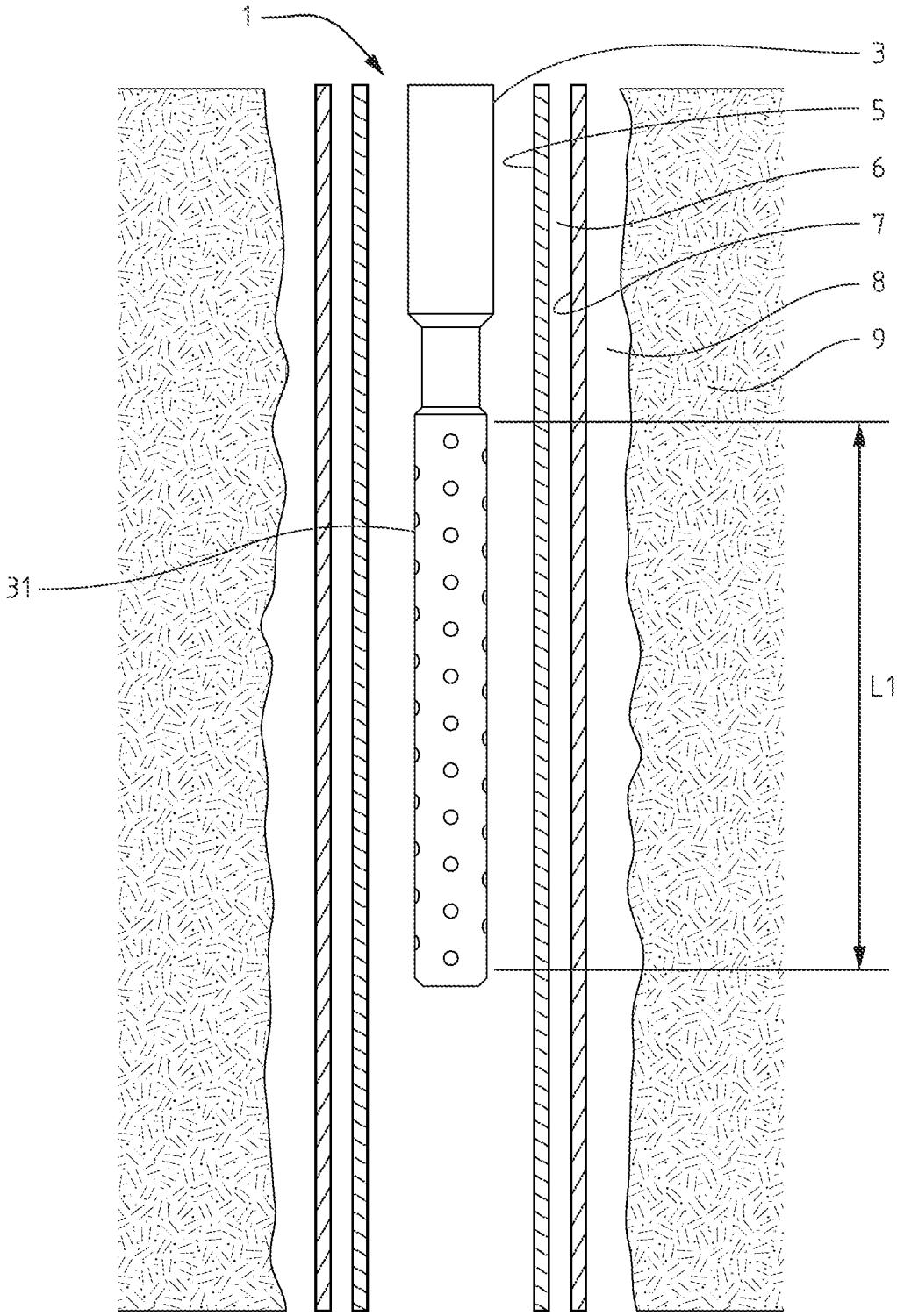
FIG. 4 shows, in a side view, the well after a perforation tool has been lowered into the well.
Figure 5:
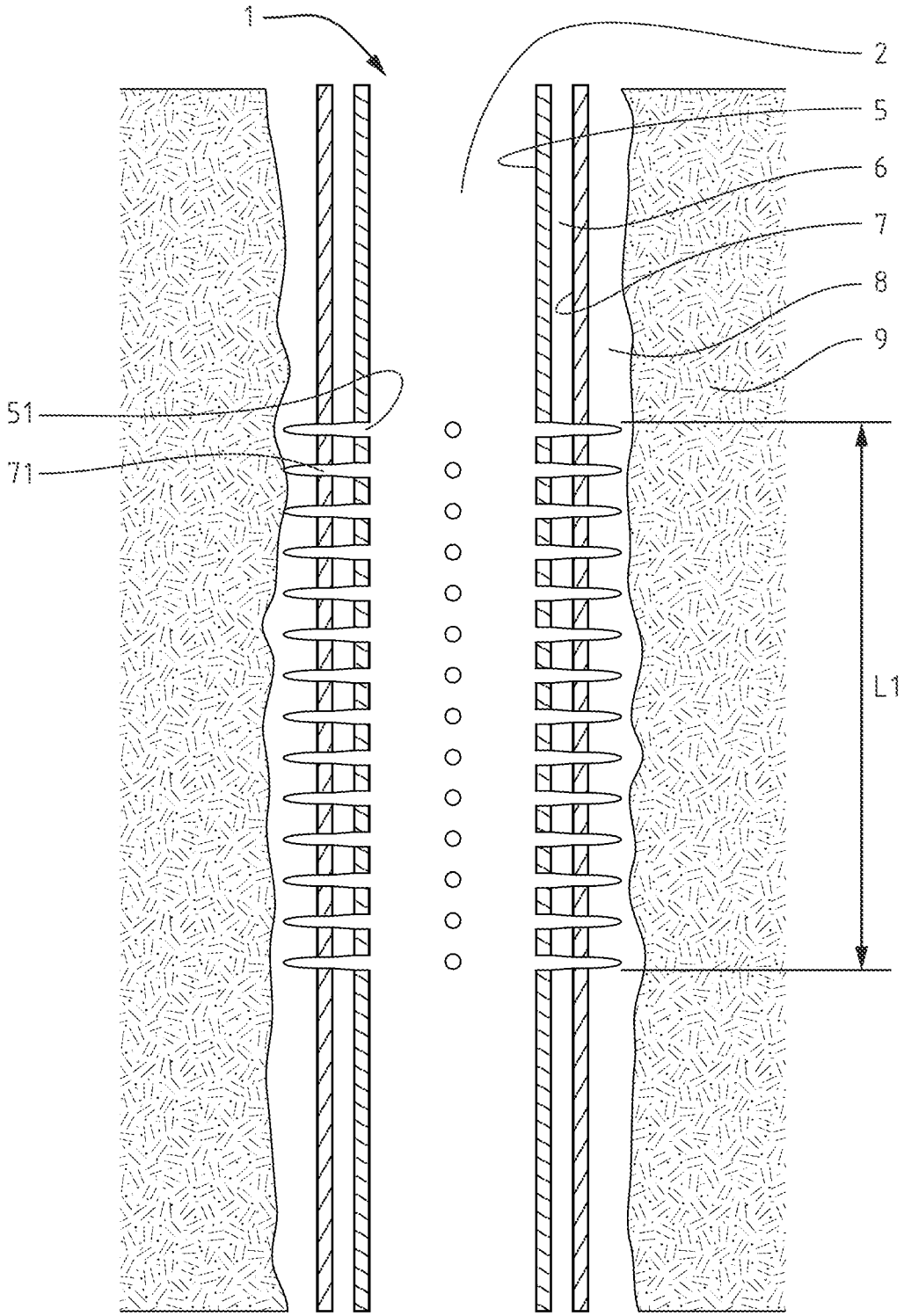
FIG. 5 shows, in a side view, the well after two pipe bodies in the well have been perforated and the perforation tool has been pulled out of the well.

FIG. 4 shows a first step in the method in accordance with the present invention. A string 3' has been lowered into the well 1 inside the innermost casing 5. To a lower portion of the string 3', a perforation tool 31 in the form of a perforation gun of a kind known per se has been connected. The perforation gun 31 is placed along a longitudinal section L1 of the well to be plugged. The perforation gun 31 forms perforations 51, 71 extending through both casings 5, 7 as shown in FIG. 5.

Figure 6:
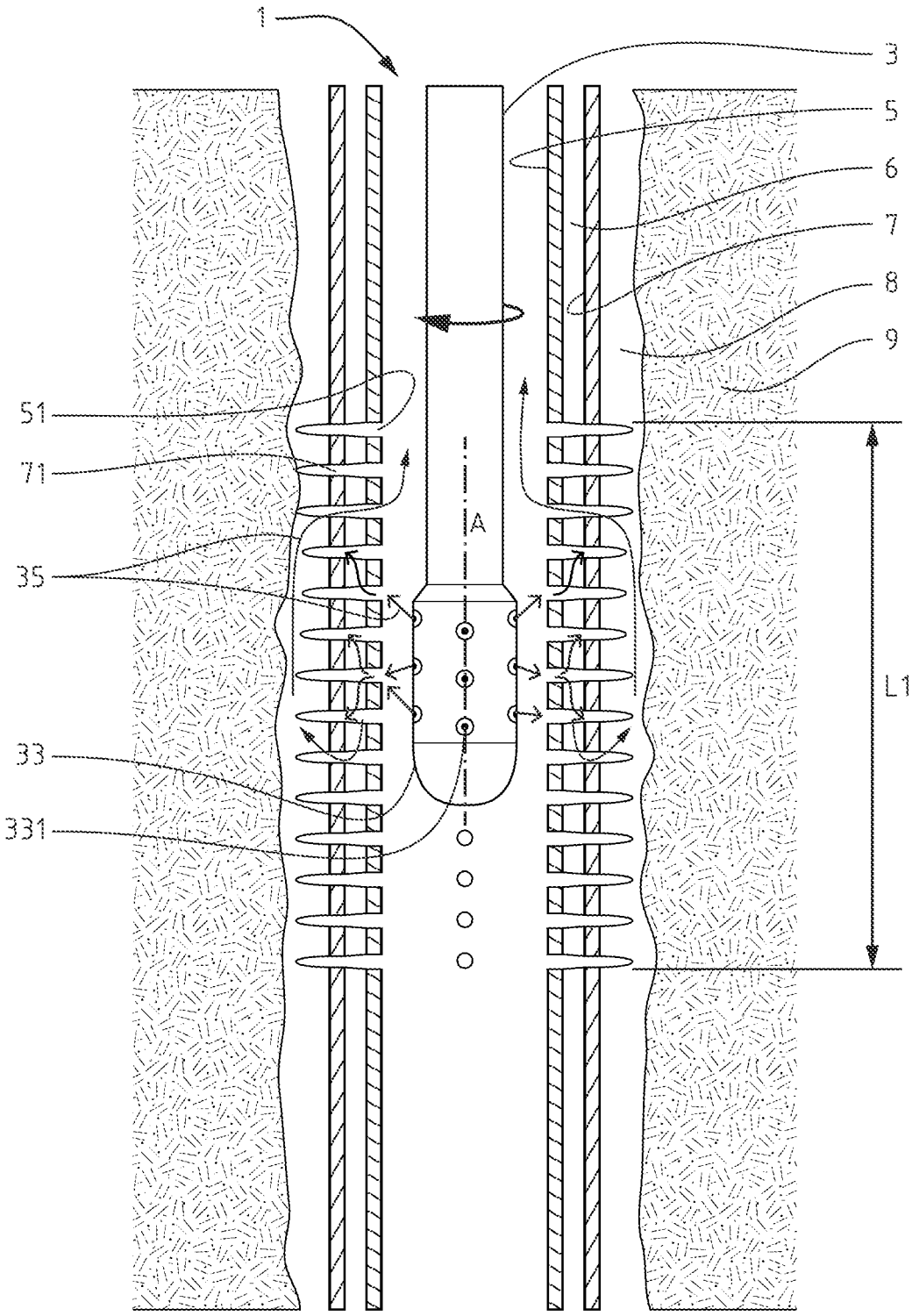
FIG. 6 shows, in a side view, the well after a flushing tool has been lowered into the well and while the flushing tool is being used for cleaning in the well.

In FIG. 6, the well is shown after a flushing tool 33 has been lowered to the longitudinal section L1 on a string 3 allowing through-flow. The string 3 allowing through-flow may be the same as the string 3', on which the perforation tool 31 was lowered into the well 1, or it may be another string. A flushing fluid 35, indicated in the figure by its output jets in the form of straight arrows out of the flushing tool 33 and its direction of flow in the form of curved arrows around the flushing tool 33, is flowing out of different outlets 331 in the flushing tool. The outlets 331 will typically be provided with nozzles for concentrating the output jets and achieving the desired concentration of the flushing fluid 35. The output jets from the outlets 331 are spin-free in a preferred embodiment. The different outlets 331 are angled in such a way that the output jets have different exit angles relative to a plane which is normal to a longitudinal axis A of the flushing tool. The angled output jets will make it possible to get sufficient cleaning of the annulus 6 between the casings 5, 7 and of the annulus 8 between the outermost casing 7 and the formation 9. The curved arrows at the flushing tool in the figures show possible flow paths of the flushing fluid 35; out towards the formation 9 via the perforations 51, 71 and back into the innermost casing 5 via other perforations 51, 71. A curved arrow at the upper portion of the string 3 indicates that the flushing tool 33 is rotating with the string 3 during flushing. In an alternative embodiment, the string 3 will, in addition or as an alternative, be moved in a reciprocating motion.

Figure 7:
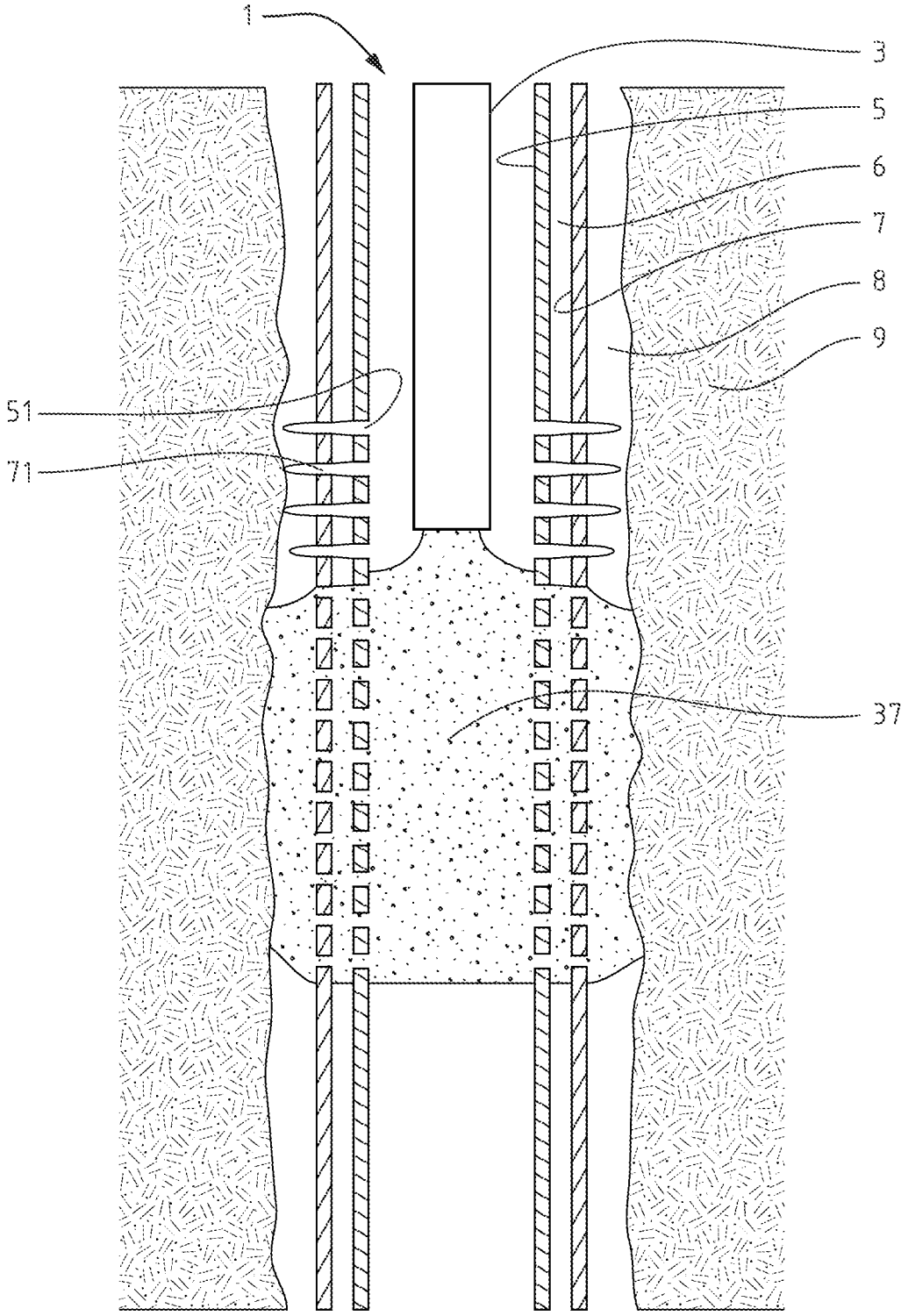
FIG. 7 shows, in a side view, the well while, in a portion, a fluidized plugging material fills substantially the entire cross section of the well.

FIG. 7 shows the well 1 as it is about to be filled over the longitudinal section L1 by a fluidized plugging material 37 flowing out of the lower end of the string 3 allowing through-flow. The fluidized plugging material 3 fills the inside of the inner casing 5 and flows on into the annulus 6 between the casings 5, 7 via the perforations 51 and further into the annulus 8 between the outermost casing 7 and the formation 9 via the perforations 71 so that substantially the entire cross section of the well 1 is filled within the longitudinal section L1. As a base for the fluidized plugging material 37 a packer element, not shown, of a type known per se may be used. Alternatively, a washing apparatus as described in the Norwegian patent document 20111641 mentioned earlier may be used after the flushing. As described in the patent document mentioned, the washing apparatus is arranged to be left in the well 1 and thus be used as a base for subsequent plugging.

Figure 8:
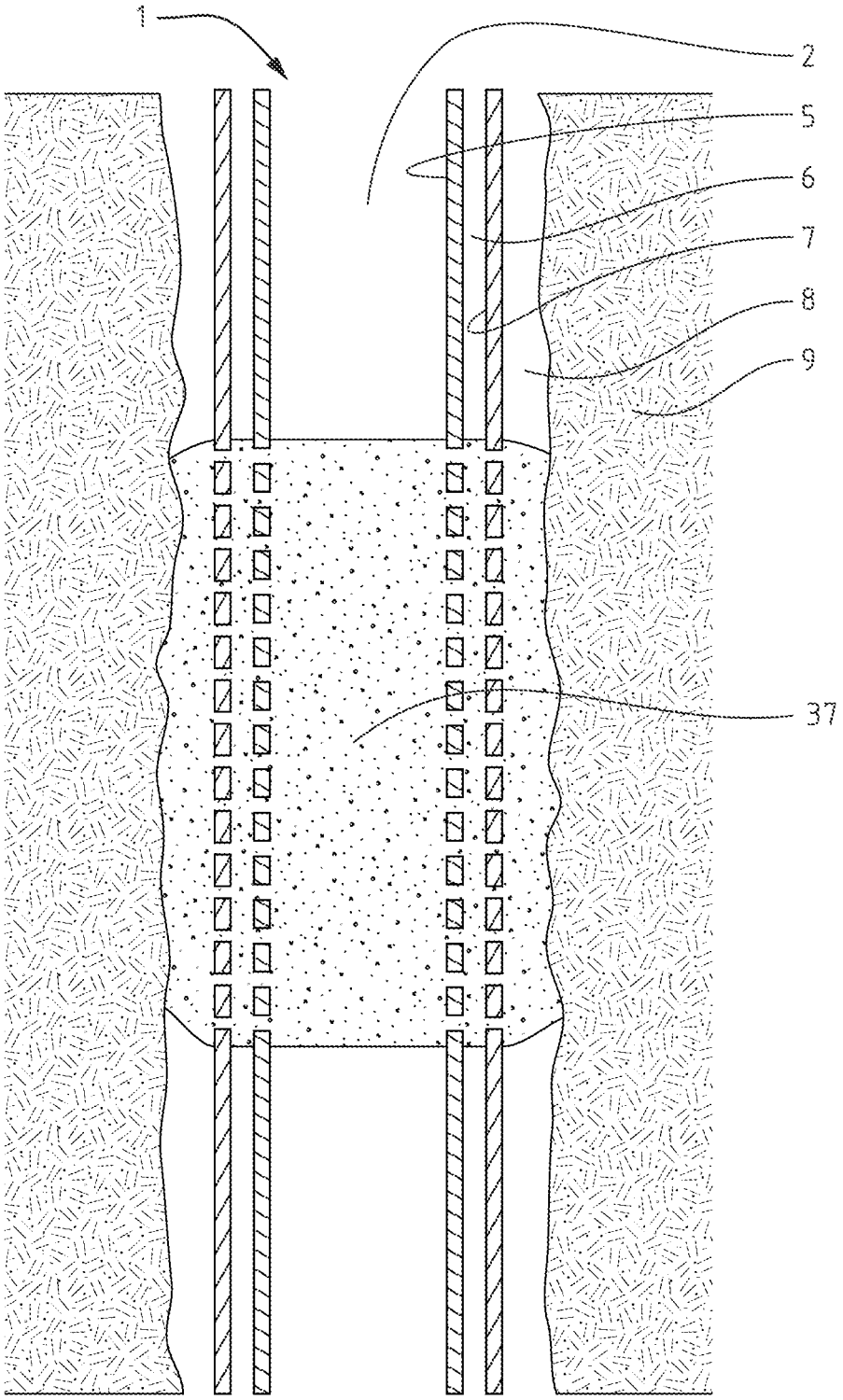
FIG. 8 shows, in a side view, the well after it has been plugged by means of the method of the present invention.

FIG. 8 shows the well 1 after the fluidized plugging material 37 has cured and a plug has been provided for temporarily or permanently closing the well 1 in accordance with the method of the present invention.

Figure 9:
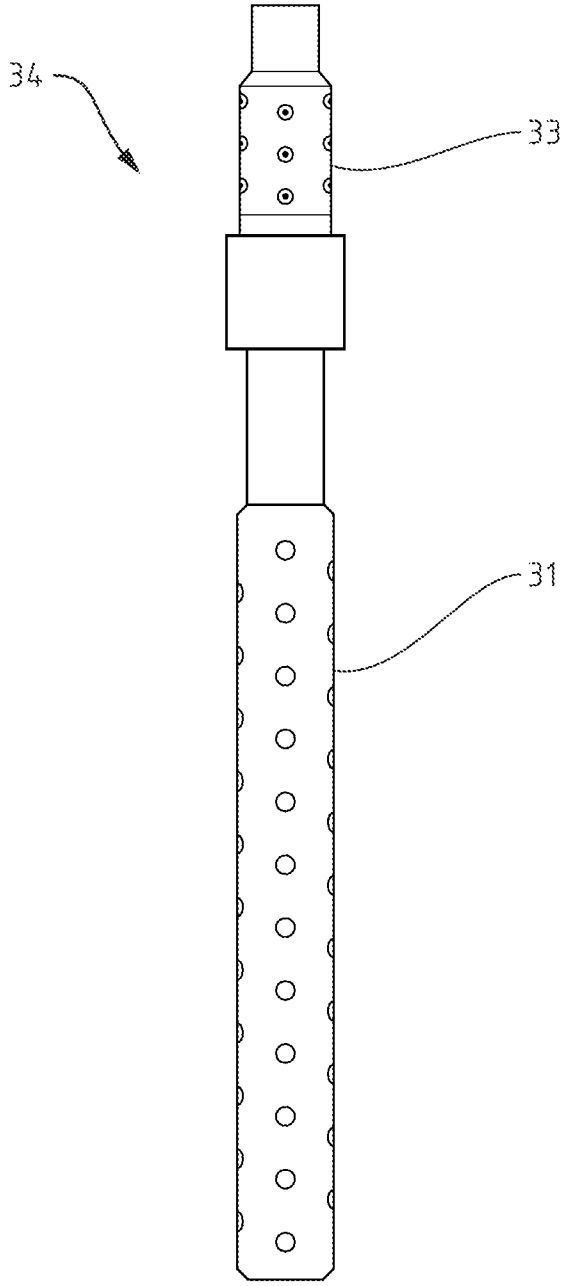
FIG. 9 shows, in a side view, a combined perforating and flushing tool for use in one embodiment of the method of the present invention.

FIG. 9 shows an assembly 34 of a perforation tool 31 and a flushing tool 33, in which the perforation tool 31 is connected to a lower end portion of the flushing tool 33 of the assembly 34. The perforation tool 31 is preferably releasable from the flushing tool 33 of the assembly 34 by means of a technique known per se. The assembly 34 will enable perforation and flushing in one and the same trip down the well 1.

The invention claimed is:

1. A method for combined perforation and cleaning of annuli in a well over a longitudinal section of the well and subsequent plugging of the longitudinal section, the annuli containing debris, the well being provided, at least over the longitudinal section, with at least two pipe bodies placed substantially concentrically, the method comprising:

(A) lowering a perforation tool into an innermost pipe body of the at least two pipe bodies to the longitudinal section of the well;

(B) with the perforation tool, forming pluralities of perforations in the at least two pipe bodies, respectively, along the longitudinal section;

(C) with a flushing tool, which is attached to a lower portion of a string allowing through-flow, and which is lowered into the innermost pipe body to the longitudinal section, pumping a flushing liquid down the string, out through a plurality of outlets formed in the flushing tool, into the innermost pipe body and, at the same time, further radially out into an annulus between the at least two pipe bodies via the plurality of perforations in the innermost pipe body, and yet further radially out into an annulus outside an outermost pipe body of the at least two pipe bodies via the plurality of perforations in the outermost pipe body, and yet further radially back into the annulus between the at least two pipe bodies via the plurality of perforations in the outermost pipe body, and yet further radially back into the innermost pipe body via the plurality of perforations in the innermost pipe body, and wherein the flushing fluid also flows longitudinally along the annulus between the at least two pipe bodies and longitudinally along the annulus outside the outermost pipe body, such that the flushing fluid flows radially inwardly and outwardly through different perforations in the pluralities of perforations, respectively, thereby cleaning the annuli by removing the debris from the annuli and further back into and out of the innermost pipe body;

wherein at least one of the plurality of outlets is angled in such a way that an output jet of the flushing liquid from the at least one of the plurality of outlets is directed non-normal to a longitudinal axis of the flushing tool, thus encouraging the flushing liquid to flow longitudinally between different perforations along the annulus between the at least two pipe bodies, and also longitudinally between different perforations along the annulus outside the outermost pipe body, so as to remove the annular debris between the different perforations along said annuli;

said plurality of outlets thus collectively encouraging the flushing liquid to flow both radially and longitudinally with respect to said longitudinal section and with respect to said pluralities of perforations in the at least two pipe bodies;

(D) pumping a fluidized plugging material down the string and into the innermost pipe body at the longitudinal section; and (E) placing the fluidized plugging material in the innermost pipe body, and thereby also in the annuli via the pluralities of perforations in the at least two pipe bodies, along at least the longitudinal section of the well, such that both the at least two pipe bodies and the annuli are plugged at the same time along at least the longitudinal section of the well.

2. The method in accordance with claim 1, wherein the fluidized plugging material comprises cement slurry for the formation of a cement plug.

3. The method in accordance with claim 1, wherein the fluidized plugging material comprises a fluidized unconsolidated mass for the formation of an unconsolidated-mass plug.

4. The method in accordance with claim 1, wherein, between (B) and (C), the method also comprises:

pulling the perforation tool out of the well; and attaching the flushing tool to the lower portion of the string to subsequently carry out (C)-(E);

whereby perforation and flushing are performed in separate trips down the well.

5. The method in accordance with claim 1, wherein, before (A), the method also comprises:

connecting the perforation tool and the flushing tool to form an assembly; and connecting the assembly to the lower portion of the string;

whereby perforation and flushing are performed in one trip down the well.

6. The method in accordance with claim 1, wherein (C) comprises rotating the string while flushing is going on.

7. The method in accordance with claim 1, wherein (C) comprises moving the string in a reciprocating motion while flushing is going on.

8. The method in accordance with claim 1, wherein, before (C), the method comprises adding an abrasive medium to the flushing liquid.

9. The method in accordance with claim 8, wherein sand is added to the flushing liquid in an amount corresponding to between 0.05 percent by weight and 1.00 percent by weight.

10. The method in accordance claim 1, wherein the flushing liquid is drilling mud.

11. The method in accordance with claim 1, wherein the flushing liquid is carried out of the plurality of outlets of the flushing tool at a rate that is greater than 15 meters per second.

12. The method in accordance with claim 11, wherein the flushing liquid is carried out of the plurality of outlets of the flushing tool at a rate that is greater than 50 meters per second.

13. The method in accordance with claim 1, wherein the flushing liquid is carried out of the plurality of outlets of the flushing tool in a substantially spin-free output jet.

14. The method in accordance with claim 1, wherein the plurality of outlets of the flushing tool are angled in such a way that output jets are distributed within ±80° from a plane which is normal to the longitudinal axis of the flushing tool.

15. The method in accordance with claim 1, wherein a lower end portion of the flushing tool is arranged to be connected to the perforation tool for perforation of surrounding pipe bodies.

16. The method in accordance with claim 15, wherein the lower end portion of the flushing tool is arranged to be releasably connected to the perforation tool.

17. The method in accordance with claim 1, wherein at least one of the plurality of outlets is provided with a nozzle.

18. The method in accordance with claim 1, wherein during (C), the flushing liquid received in the annulus outside the outermost pipe body returns through other of the perforations back into the innermost pipe body.

19. A method for combined perforation and cleaning of annuli in a well over a longitudinal section of the well and subsequent plugging of the longitudinal section, the annuli containing debris, the well being provided, at least over the longitudinal section, with at least two pipe bodies placed substantially concentrically, the method comprising:

(A) lowering a perforation tool into an innermost pipe body of the at least two pipe bodies to the longitudinal section of the well;

(B) with the perforation tool, forming pluralities of perforations in the at least two pipe bodies, respectively, along the longitudinal section;

(C) with a flushing tool, which is attached to a lower portion of a string allowing through-flow, and which is lowered into the innermost pipe body to the longitudinal section, pumping a flushing liquid down the string, out through at least one outlet of the flushing tool, into the innermost pipe body and, at the same time, further radially out into an annulus between the at least two pipe bodies via the plurality of perforations in the innermost pipe body, and yet further radially out into an annulus outside an outermost pipe body of the at least two pipe bodies via the plurality of perforations in the outermost pipe body, and yet further radially back into the annulus between the at least two pipe bodies via the plurality perforations in the outermost pipe body, and yet further radially back into the innermost pipe body via the plurality of perforations in the innermost pipe body, and wherein the flushing fluid also flows longitudinally along the annulus between the at least two pipe bodies and longitudinally along the annulus outside of the outermost pipe body, such that the flushing fluid flows radially inwardly and outwardly through different perforations in the plurality of perforations, respectively, thereby cleaning the annuli by removing the debris from the annuli and further out of the innermost pipe body;

wherein the flushing tool is formed with a plurality of outlets allowing through-flow; and wherein at least one of the plurality of outlets is angled in such a way that an output jet of the flushing liquid from the at least one of the plurality of outlets is directed non-normal to a longitudinal axis of the flushing tool, thus encouraging the flushing fluid to flow both radially and longitudinally with respect to said longitudinal section and with respect to said pluralities of perforations;

(D) pumping a fluidized plugging material down the string and into the innermost pipe body at the longitudinal section; and (E) placing the fluidized plugging material in the innermost pipe body, and thereby also in the annuli via the pluralities of perforations in the at least two pipe bodies, along at least the longitudinal section of the well, such that both the at least two pipe bodies and the annuli are plugged at the same time along at least the longitudinal section of the well.

* * * * *